US010078979B2

(12) United States Patent
Li et al.

(10) Patent No.: US 10,078,979 B2
(45) Date of Patent: Sep. 18, 2018

(54) DISPLAY PANEL WITH PIXEL CIRCUIT HAVING A PLURALITY OF LIGHT-EMITTING ELEMENTS AND DRIVING METHOD THEREOF

(71) Applicants: SHANGHAI TIANMA AM-OLED CO., LTD., Shanghai (CN); TIANMA MICRO-ELECTRONICS CO., LTD., Shenzhen (CN)

(72) Inventors: Qi Li, Shanghai (CN); Dong Qian, Shanghai (CN); Duzen Peng, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 86 days.

(21) Appl. No.: 15/181,557

(22) Filed: Jun. 14, 2016

(65) Prior Publication Data

US 2017/0229056 A1 Aug. 10, 2017

(30) Foreign Application Priority Data

Feb. 4, 2016 (CN) ..... 2016 1 0081027

(51) Int. Cl.
*G09G 3/32* (2016.01)
*G09G 3/20* (2006.01)

(52) U.S. Cl.
CPC ... *G09G 3/2092* (2013.01); *G09G 2300/0426* (2013.01); *G09G 2330/02* (2013.01)

(58) Field of Classification Search
CPC ..... G09G 3/2092
(Continued)

(56) References Cited

U.S. PATENT DOCUMENTS

2006/0125807 A1* 6/2006 Park ..... G09G 3/3233 345/204
2006/0139257 A1* 6/2006 Kwak ..... G09G 3/3233 345/76

(Continued)

FOREIGN PATENT DOCUMENTS

CN 1716369 A 1/2006
CN 104252845 A 12/2014

(Continued)

*Primary Examiner* — Long D Pham
(74) *Attorney, Agent, or Firm* — Kilpatrick Townsend & Stockton LLP

(57) ABSTRACT

A pixel circuit, a driving method and a display panel are provided by the disclosure. The pixel circuit includes: a sharing unit and N light-emitting control units. An input terminal of each of the light-emitting control units is electrically connected to an output terminal of the sharing unit; an output terminal of each of the light-emitting control units is electrically connected to a light-emitting element, a control terminal of each of the light-emitting control units is electrically connected a control signal line. The sharing unit is configured to drive, through each of the light-emitting control units. The light-emitting element electrically connected to the light-emitting control unit. N is positive integer greater than or equal to 2. The pixel circuit, the driving method and the display panel of the disclosure may solve the problem of the non-uniform display due to the drift of the threshold voltage of the driving transistor.

7 Claims, 4 Drawing Sheets

(58) Field of Classification Search
USPC ..... 345/82
See application file for complete search history.

(56) References Cited

U.S. PATENT DOCUMENTS

| | | | | |
|---|---|---|---|---|
| 2016/0225312 | A1* | 8/2016 | Byun | G09G 3/3208 |
| 2016/0372049 | A1* | 12/2016 | Wang | G09G 3/3225 |
| 2017/0061876 | A1* | 3/2017 | Cho | G09G 3/3233 |

FOREIGN PATENT DOCUMENTS

| | | | |
|---|---|---|---|
| CN | 204117568 | U | 1/2015 |
| CN | 104409042 | A | 3/2015 |

* cited by examiner

DISPLAY PANEL WITH PIXEL CIRCUIT HAVING A PLURALITY OF LIGHT-EMITTING ELEMENTS AND DRIVING METHOD THEREOF

CROSS-REFERENCES TO RELATED APPLICATIONS

This application claims priority to Chinese Patent Application No. 201610081027.7, filed with the Chinese Patent Office on Feb. 4, 2016 and entitled "Pixel Circuit, Driving Method And Display Panel", the contents of which are incorporated herein by reference in their entirety.

TECHNICAL FIELD

The present disclosure relates to the field of organic light-emitting display technologies, particularly to a pixel circuit, a driving method and a display panel.

BACKGROUND

Compared with the conventional liquid crystal display panels, the organic light-emitting display panel has advantages such as fast response, high contrast and wide viewing angle etc. The organic light-emitting display panel can emit light because of the driving current generated by driving transistor in the saturation region. However, due to the reason such as the aging of the device, the threshold voltage of the driving transistor would drift, so that the driving current is changed, thereby causing the change in the luminance of light emitted by the organic light-emitting display panel and affecting the display uniformity.

For solving a problem of the non-uniform display of the light-emitting display panel due to the drift of the threshold voltage of the driving transistor, it is generally to design a circuit with complicated structures to compensate for the threshold voltage of the driving transistor. That is, it is needed to provide a complicated compensation circuit for each light-emitting transistor. However, as the demands of increasing the resolution and of decreasing the pixel area in the light-emitting display panel, the challenge that the complicated circuit can be made in a reduced pixel area becomes increasing in processes. Hence, it is needed to provide a technology by means of which the problem of the non-uniform display due to the drift of the threshold voltage of the driving transistor can be solved, and with which the processes of the related art can also be compatible, thereby improving the resolution of the light-emitting display panel.

SUMMARY

Embodiments provide a pixel circuit, a driving method and a display panel, to solve the problem of the non-uniform display due to the drift of the threshold voltage of the driving transistor, and to be able to be compatible with the processes in the related art, thereby improving the resolution of the display panel.

In a first aspect, a pixel circuit provided by the embodiments of the disclosure comprises a sharing unit and N light-emitting control units. An input terminal of each of the N light-emitting control units is electrically connected to an output terminal of the sharing unit; an output terminal of each of the N light-emitting control units is electrically connected to a light-emitting element. A control terminal of each of the N light-emitting control units is configured to be electrically connected to a respective one of N control signal lines. The sharing unit is configured to drive, through each of the light-emitting control units, the light-emitting element electrically connected to the light-emitting control unit; where N is positive integer greater than or equal to 2.

In some embodiments, the sharing unit is electrically connected to a power signal line, a data line and at least one scan line, to receive a power supply voltage signal, a data signal and at least one scan signal, respectively.

In some embodiments, the light-emitting control unit comprises a first transistor, and the light-emitting element is a light-emitting diode; an output terminal of the first transistor is electrically connected to an anode of the light-emitting diode, and an control terminal of each of the first transistors is electrically connected to the corresponding control signal line; a cathode of the light-emitting diode is electrically connected to the ground.

In some embodiments, the sharing unit comprises a second transistor, a third transistor, a fourth transistor, a fifth transistor, a sixth transistor and a first capacitor. An input terminal of the second transistor is electrically connected to a reference signal line, and an output terminal of the second transistor is electrically connected to a first terminal of the first capacitor, and a control terminal of the second transistor is electrically connected to a first scan line. An input terminal of the third transistor is electrically connected to the power signal line, an output terminal of the third transistor is electrically connected to an input terminal of the fourth transistor, the control terminal of the third transistor is electrically connected to a strobe signal line; an input terminal of the fifth transistor is electrically connected to the data line, an output terminal of the fifth transistor is electrically connected to the input terminal of the fourth transistor, an control terminal of the fifth transistor is electrically connected to a second scan line; a control terminal of the fourth transistor is electrically connected to the first terminal of the first capacitor; an input terminal of the sixth transistor is electrically connected to an output terminal of the fourth transistor, an output terminal of the sixth transistor electrically is connected to the first terminal of the first capacitor, an control terminal of the sixth transistor is electrically connected to the second scan line; and a second terminal of the first capacitor is electrically connected to the power supply signal line.

In some embodiments, the sharing unit includes a seventh transistor, an eighth transistor, a ninth transistor, a second capacitor and a third capacitor. The pixel circuit further comprises N tenth transistors. An input terminal of each of the N tenth transistors is electrically connected to the reference signal line, an output terminal of each of the N tenth transistors is electrically connected to a second terminal of the second capacitor, a control terminal of each of the N tenth transistors is electrically connected to a control signal line. An input terminal of the ninth transistor is electrically connected to the data line, an output terminal of the ninth transistor is electrically connected to the second terminal of the second capacitor, a control terminal of the ninth transistor is electrically connected to a scan line. An input terminal of the seventh transistor is electrically connected to the power signal line, a control terminal of the seventh transistor is electrically connected to a first terminal of the second capacitor, and an input terminal of the eighth transistor is electrically connected to an output terminal of the seventh transistor, an output terminal of the eighth transistor is electrically connected to the first terminal of the second capacitor and the first terminal of the third capacitor, a control terminal of the eighth transistor is electrically connected to the scan line and the second terminal of the third capacitor.

In a second aspect, a display panel provided by the embodiments of the disclosure comprises pixel circuits described in the first aspect and a plurality of light-emitting elements.

The plurality of light-emitting elements are arranged in an array, and N light-emitting elements in a row of the array share the sharing unit of one of the pixel circuits that drives the N light-emitting elements in the row of the array to emit light one by one.

In a third aspect, a pixel circuit driving method provided by the embodiments of the disclosure for driving the pixel circuit above described, comprises: performing a reset step, an writing and compensating step, and a light-emitting step.

in the reset step, under the control of a scan signal of the first scan line, the second transistor is turned on, so that a reference voltage is written into the first terminal of the first capacitor through the reference signal line and the voltage of the control terminal of the fourth transistor is reset.

In the writing and compensating step, under the control of a scan signal of the second scan line, the fifth transistor, the fourth transistor and the sixth transistor are turned on, so that the data signal is inputted through the data line, and the potential of the first terminal of the first capacitor increases until the fourth transistor is turned off.

In the light-emitting step, under the control of the input voltage of a strobe signal line and the input voltage of a control signal line, the third transistor and the first transistor electrically connected to the control signal line are turned on, so that the light-emitting diode electrically connected to the first transistor emits light.

The method comprises repeatedly performing the reset step, the writing and compensating step and the light-emitting step in sequence until the N light-emitting diodes emit light one by one.

In a fourth aspect, another pixel circuit driving method provided by the embodiments of the disclosure comprises: performing a writing and compensating step, and a light-emitting step.

In the writing and compensate step, under the control of a scan signal of the scan line, the ninth transistor and the eighth transistor are turned on, so that the data line inputs the data signal to the second terminal of the second capacitor, the third capacitor pulls down the potential of the first terminal of the second capacitor, the seventh transistor is turned on, and the power signal line inputs the power supply voltage, and the potential of the first terminal of the second capacitor increases until the seventh transistor is turn off.

In the light-emitting step, under the control of an input voltage of the control signal line, the tenth transistor and the first transistor electrically connected to the control signal line are turned on, so that the reference signal line inputs the reference voltage to the second terminal of the second capacitor, and the seventh transistor is turned on, the light-emitting diode electrically connected to the first transistor emits light; and Repeatedly performing the writing and compensate step and the light-emitting step in sequence until the N light-emitting diodes emit light one by one.

In the embodiments of the disclosure, the pixel circuit comprises a sharing unit and N light-emitting control units. The sharing unit is configured to drive, through each of the light-emitting control units, the light-emitting element electrically connected to the output terminal of the light-emitting control unit to emit light, so that the adjacent N light-emitting elements in a display panel may share one pixel circuit, that is, N light-emitting elements may be disposed in an area of the pixel circuit, thereby simplifying the circuit structure of the display panel while providing the function of the pixel circuit in the related art, and hence in such pixel circuit, not only the problem of the non-uniform display of the organic light-emitting display panel due to the drift of the threshold voltage of the driving transistor can be solved, but also the resolution of the display panel can be improved significantly.

DETAILED DESCRIPTION

For better understanding of the disclosure, the disclosure will be further described below with reference to the accompanying drawings and embodiments. It may be understood that specific embodiments described herein are merely for explaining the present disclosure rather than limiting the present disclosure. Moreover, it is noted that only parts related to the disclosure, rather than the entire structure are shown in the accompanying drawings.

Figure 1:
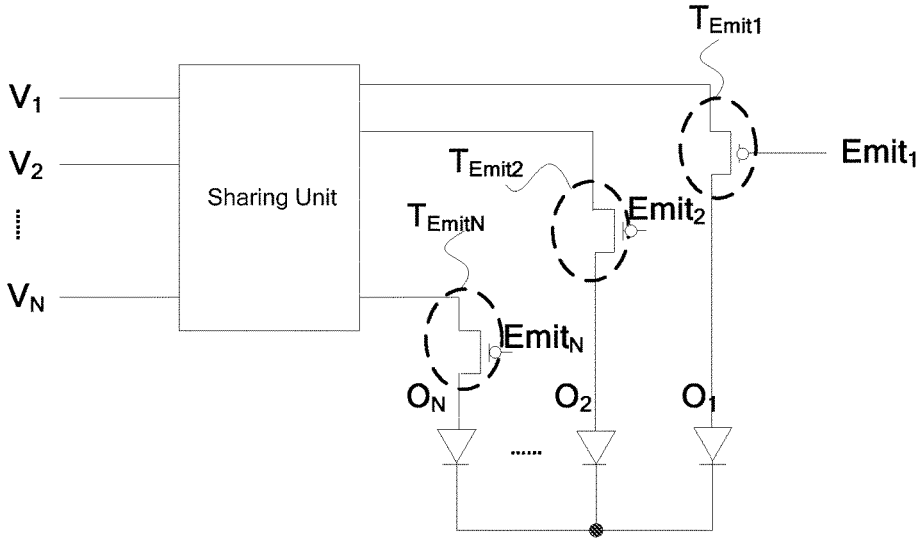
FIG. 1 is a schematic diagram showing the structure of a pixel circuit provided by an embodiment of the disclosure.

FIG. 1 is a schematic diagram showing the structure of a pixel circuit provided by an embodiment of the disclosure. As shown in FIG. 1, a pixel circuit includes: a sharing unit and N light-emitting control units $T_{EmitN}$, where N is positive integer greater than or equal to two.

An input terminal of each of the light-emitting control units $T_{EmitN}$ is electrically connected to an output terminal of the sharing unit. An output terminal of each of the light-emitting units $T_{EmitN}$ is electrically connected to a corresponding light-emitting element $O_N$, an control terminal of each of light-emitting control units $T_{EmitN}$ is electrically connected to a corresponding control signal line $Emit_N$. An input terminal of the sharing unit is electrically connected to a data lines $V_N$, to receive corresponding data signals. The sharing unit is configured to drive, through each of the light-emitting control units $T_{EmitN}$, the light-emitting element $O_N$ electrically connected to the output terminal of the light-emitting control unit $T_{EmitN}$ to emit light. Referring to the pixel circuit shown in FIG. 1, it is noted that the pixel circuit in FIG. 1 can control the N light-emitting elements $O_N$ to emit light one by one, so that the N light-emitting elements $O_N$ may be disposed above the region of the pixel circuit in manufacturing the display panel, thus significantly improving the resolution of the display panel as compared with the configuration in the related art that one light-emitting element is disposed above one pixel circuit.

A core idea of the disclosure is described above. The sharing unit can be implemented in many ways, and the connection between the sharing unit and other devices of the pixel circuit can be implemented in many ways. The technical solutions of the embodiments of the present disclosure will be clearly and completely described below with reference to accompanying drawings. Obviously, the described embodiments are just a part of the embodiments of the disclosure, rather than all the embodiments. Based on the embodiments in the disclosure, other embodiments obtained by those skilled in the art without creative work also belong to the scope of protection of the present disclosure.

On the basis of the pixel circuit provided in FIG. 1, in some embodiments, the sharing unit provided by an embodiment of the disclosure is electrically connected to a power signal line VDD, a data line VDATA and at least one scan line SCAN, to receive a power supply voltage signal, data signals and at least one scan signal respectively.

Figure 2:
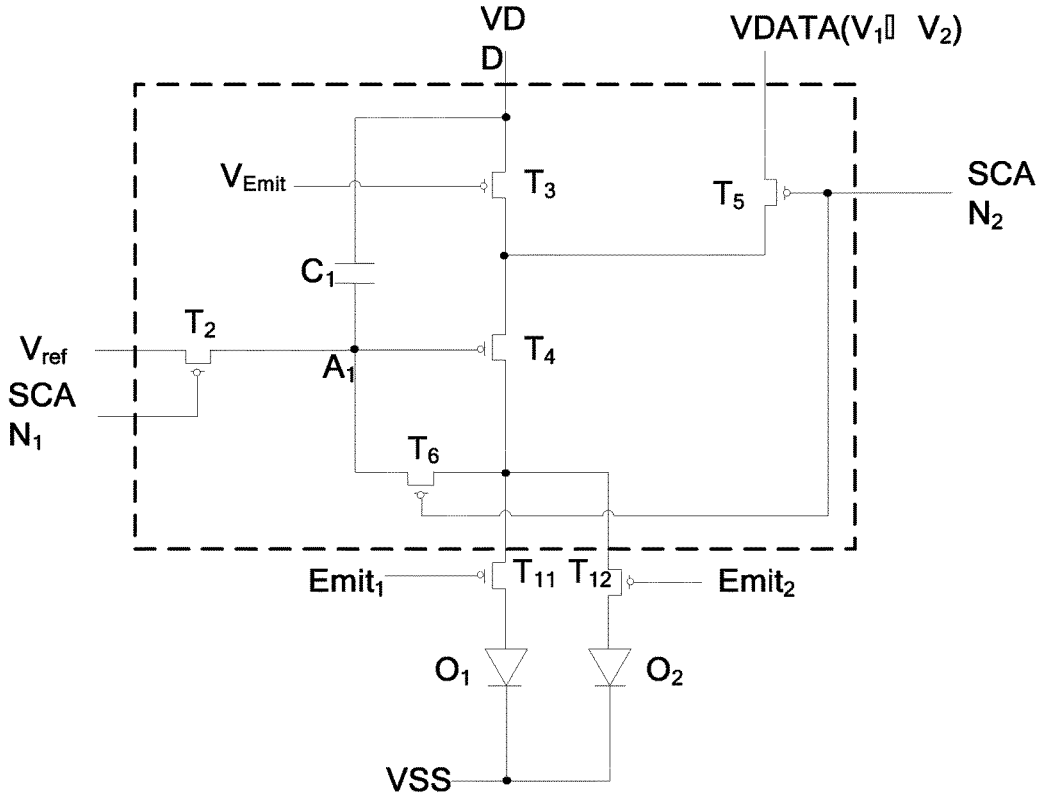
FIG. 2 is a schematic diagram showing the structure of another pixel circuit provided by an embodiment of the disclosure.

FIG. 2 is a schematic diagram showing the structure of another pixel circuit provided by an embodiment. As shown in FIG. 2, illustratively, the pixel circuit in the embodiment includes two light-emitting control units. That is, N is equal to 2. Each light-emitting control unit includes a first transistor. For easy description, the first transistors of the two light-emitting control units are referred to as the first transistor $T_{11}$ and the first transistor $T_{12}$ respectively. The light-emitting element $O_N$ is a light-emitting diode (which is also indicated by $O_N$ for easy description). An output terminal of the first transistor $T_{11}$ is electrically connected to an anode of the light-emitting diode $O_1$, and an output terminal of the first transistor $T_{12}$ is electrically connected to an anode of the light-emitting diode $O_2$. A control terminal of the first transistor $T_{11}$ is electrically connected to a control signal line $Emit_1$, and a control terminal of the first transistor $T_{12}$ is electrically connected to a control signal line $Emit_2$. Each of cathodes of the light-emitting diode $O_1$ and the light-emitting diode $O_2$ is connected to the ground (i.e., a ground line VSS).

The sharing unit (that is, the region in the dash line box) includes: a second transistor $T_2$, a third transistor $T_3$, a fourth transistor $T_4$, a fifth transistor $T_5$, a sixth transistor $T_6$ and a first capacitor $C_1$. An input terminal of the second transistor $T_2$ is electrically connected to a reference signal line $V_{ref}$, an output terminal of the second transistor $T_2$ is electrically connected to a first terminal of the first capacitor $C_1$, and a control terminal of the second transistor $T_2$ is electrically connected to a first scan line $SCAN_1$. An input terminal of the third transistor $T_3$ is electrically connected to the power signal line VDD, an output terminal of the third transistor $T_3$ is electrically connected to an input terminal of the fourth transistor $T_4$, and a control terminal of the third transistor $T_3$ is electrically connected to a strobe signal line $V_{Emit}$. An input terminal of the fifth transistor $T_5$ is electrically connected to the corresponding data lines (including $V_1$ and $V_2$), an output terminal of the fifth transistor $T_5$ is electrically connected to an input terminal of the fourth transistor $T_4$, and a control terminal of the fifth transistor $T_5$ is electrically connected to a second scan line $SCAN_2$. A control terminal of the fourth transistor $T_4$ is electrically connected to the first terminal of the first capacitor $C_1$. An input terminal of the sixth transistor $T_6$ is electrically connected to the output terminal of the fourth transistor $T_4$, an output terminal of the sixth transistor $T_6$ is electrically connected to the first terminal of the first capacitor $C_1$, and a control terminal of the sixth transistor $T_6$ is electrically connected to the second scan line $SCAN_2$. A second terminal of the first capacitor $C_1$ is electrically connected to the power signal line VDD. It is noted that the pixel circuit illustratively shown in FIG. 2 includes two light-emitting control units (that is, two first transistors), which is not a limited thereto, and in other embodiments, the number of the light-emitting control units may be specifically arranged based on the requirements of real products.

It is noted that in the embodiments of the disclosure, the first transistors, the second transistor, the third transistor, the fourth transistor, the fifth transistor and the sixth transistor may be N-channel transistors, and may also be P-channel transistors. In driving the light-emitting diode by the pixel circuit, the input signals (such as high level signal and low level signal) may be changed based on the channel types of the first transistor, the second transistor, the third transistor, the fourth transistor, the fifth transistor and the sixth transistor. In the present embodiment, the first transistor, the second transistor, the third transistor, the fourth transistor, the fifth transistor and the sixth transistor have same channel type, thus simplifying the structure of the pixel circuit and reducing the area occupied by the pixel circuit.

For easy description, hereinafter, the data signal voltages of the data line are represented by $V_N$, the voltage of the power signal line is represented by VDD, the voltage of the corresponding scan line is represented by SCAN. The voltage of the reference signal line is represented by $V_{ref}$.

Figure 3:
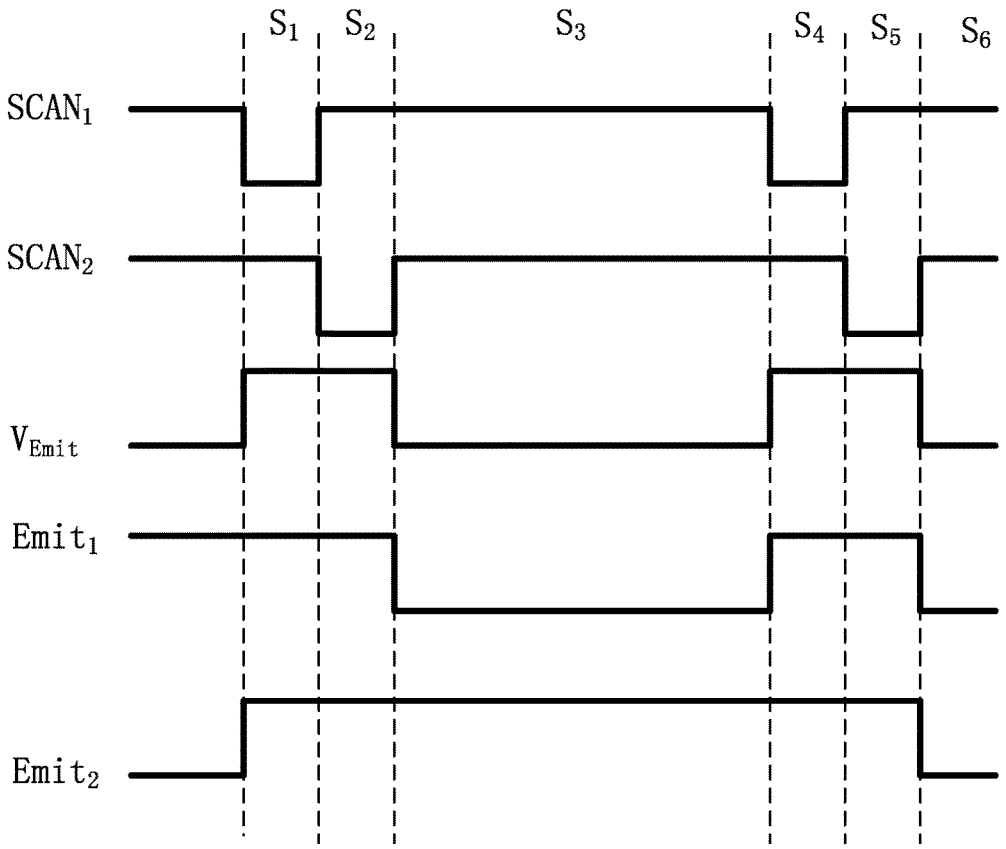
FIG. 3 is the timing diagram of a pixel circuit driving method provided by the an embodiment of the disclosure.

An embodiment also provides a pixel circuit driving method used for the pixel circuit shown in FIG. 2. Illustratively, the driving method provided by the present embodiment is described using the first transistor, the second transistor, the third transistor, the fourth transistor, the fifth transistor and the sixth transistor, of P-channel. FIG. 3 is the timing diagram of the pixel circuit driving method provided by the present embodiment. In combination of the pixel circuit shown in FIG. 2 with the timing diagram of the pixel circuit driving method shown in FIG. 3, the pixel circuit driving method includes: a first reset step $S_1$, a first writing and compensating step $S_2$, a first light-emitting step $S_3$, a second reset step $S_4$, a second writing and compensating step $S_5$, and a second light-emitting step $S_6$.

In the first reset step $S_1$, the scan signal of the first scan line $SCAN_1$ is at a low level. Under the control of the scan signal of the first scan line $SCAN_1$, the second transistor is turned on, so that the reference voltage $V_{ref}$ is written into the first terminal (that is, node $A_1$ in FIG. 2) of the first capacitor $C_1$ through the reference signal line, and hence the potential value of node $A_1$ is $V_{ref}$, and thereby the potential of the control terminal of the fourth transistor $T_4$ is reset.

In the first writing and compensating step $S_2$, the scan signal of the second scan line $SCAN_2$ is at a low level. Under the control of the scan signal of the second scan line $SCAN_2$, the fifth transistor $T_5$, the fourth transistor $T_4$ and the sixth transistor $T_6$ are turned on, so that the data line inputs a data signal $V_1$. When the potential of the first terminal of the first capacitor $C_1$ is pulled up to $V_1-|V_{th}|$ (where $V_{th}$ is the threshold voltage of the fourth transistor $T_4$), the fourth transistor $T_4$ is turned off, and hence the potential difference between the second terminal and the first terminal of the first capacitor $C_1$ is $VDD-V_1+|V_{th}|$, thus achieving the data inputting and threshold voltage compensation.

In the first light-emitting step $S_3$, the input voltages of the strobe signal line $V_{Emit}$ and the control signal line $Emit_1$ are both at a low level. Under the control of the input voltages of the strobe signal line $V_{Emit}$ and the control signal line $Emit_1$, the third transistor $T_3$ and the first transistor $T_{11}$ electrically connected to the control signal line $Emit_1$ are turned on, so that the light-emitting diode $O_1$ electrically connected to the first transistor $T_{11}$ emits light. The current formula of the light-emitting diode is: $I=K(V_{SG}-|V_{th}|)^2$, where I represents the current of the light-emitting diode, K is a parameter related to the process parameters and critical dimension of the driving transistor, $V_{SG}$ represents the potential difference between the input terminal of the driving transistor and the control terminal of the driving transistor (that is, the potential difference between the potential of the source electrode and the potential of the gate electrode), and $V_{th}$ is the threshold voltage of the driving transistor. Thus, the current flowing through the light-emitting diode O1 is $I_1=K[|VDD-(V_1-|V_{th}|)|-|V_{th}|]^2=K(VDD-V_1)^2$, and is independent of the threshold voltage $V_{th}$ of the fourth transistor $T_4$ (that is, the driving transistor), where K is a parameter related to the process parameters and critical dimension of the driving transistor.

In the second reset step $S_4$, the scan signal of the first scan line $SCAN_1$ is at a low level. Under the control of the scan signal of the first scan line $SCAN_1$, the second transistor $T_2$ is turned on, so that the reference voltage $V_{ref}$ is written into the first terminal of the first capacitor $C_1$ through the reference signal line, and hence the potential value of node $A_1$ is $V_{ref}$, and thereby the potential of the control terminal of the fourth transistor $T_4$ is reset.

In the second writing and compensating step $S_5$, the scan signal of the second scan line $SCAN_2$ is at a low level. Under the control of the scan signal of the second scan line $SCAN_2$, the fifth transistor $T_5$, the fourth transistor $T_4$ and the sixth transistor $T_6$ are turned on, the data line inputs a data signal $V_2$, when the potential of the first terminal of the first capacitor $C_1$ is pulled up to $V_2-|V_{th}|$ (where $V_{th}$ is the threshold voltage of the fourth transistor $T_4$), the fourth transistor $T_4$ is turned off, and hence the potential difference between the second terminal and the first terminal of the first capacitor $C_1$ is $VDD-V_2+V_{th}|$, thus achieving the data inputting and threshold voltage compensation.

In the second light-emitting step $S_6$, the input voltages of the strobe signal line $V_{Emit}$ and the control signal line $Emit_2$ are both at a low level. Under the control of the input voltages of the strobe signal line $V_{Emit}$ and the control signal line $Emit_2$, the third transistor $T_3$ and the first transistor $T_{12}$ electrically connected to the control signal line $Emit_2$ are turned on, so that the light-emitting diode $O_2$ electrically connected to the first transistor $T_{12}$ emits light. According to the current calculating formula of the light-emitting diode $I=K(V_{SG}-|V_{th})^2$, the current of the light-emitting diode $O_2$ is $I_2=K[|VDD-(V_2-|V_{th}|)|-|V_{th}|]^2=K(VDD-V_2)^2$ So far, scan displaying of a frame of image has finished, and the scan display of the next frame of image will start when next SCAN1 with a low level arrives. The display process is repeated in such a way.

In this embodiment, the driving method for the pixel circuit enables the current of the light-emitting diode to be independent of the threshold voltage of the fourth transistor (i.e., the driving transistor), thus effectively solving the problem of the non-uniform display due to the drift of the threshold voltage of the driving transistor. In addition, unlike the configuration in the related art that a pixel circuit is provided for each of the light-emitting diodes and a complicated circuit is arranged in the region of the pixel unit including the light-emitting diode in order to solve the problem of the non-uniform display due to the drift of the threshold voltage of the driving transistor. In the present embodiment, more than one light-emitting diodes is configured to share a pixel circuit, so that the light-emitting diodes can be disposed in the region of the pixel circuit, that is, more than one pixel units may be disposed in the region of the pixel circuit, thus sufficiently decreasing the size of the pixel unit and significantly improving the resolution of the display panel.

When the pixel circuit comprises N light-emitting control unit, and each of the light-emitting control units includes a first transistor, the driving method for the pixel circuit includes: a reset step, a writing and compensating step and a light-emitting step.

In the reset step, under the control of a scan signal of the first scan line, the second transistor is turned on, so that a reference voltage is written into the first terminal of the first capacitor through the reference signal line, and the voltage of the control terminal of the fourth transistor is reset.

In the writing and compensating step, under the control of a scan signal of the second scan line, the fifth transistor, the fourth transistor and the sixth transistor are turned on, so that the data signal is inputted through the data line, and the potential of the first terminal of the first capacitor is pulled up to turn off the fourth transistor.

In the light-emitting step, under the control of the input voltage of the strobe signal line and the input voltage of the control signal line, the third transistor and the first transistor electrically connected to the control signal line are turned on, so that the light-emitting diode electrically connected to the first transistor emits light.

By this method, the reset step, the writing and compensating step and the light-emitting step described above are performed repeatedly in sequence until the N light-emitting diodes emit light one by one.

It is noted that the first transistor, the second transistor, the third transistor, the fourth transistor, the fifth transistor and the sixth transistor are illustratively defined as P-channel transistors to describe the above embodiment. When the first transistor, the second transistor, the third transistor, the fourth transistor, the fifth transistor and the sixth transistor all are N-channel, the scan signal of each of the scan lines, the input voltage of the strobe signal line and the input voltage of each control signal line in FIG. 3 are changed from a low level to a high level.

Figure 4:
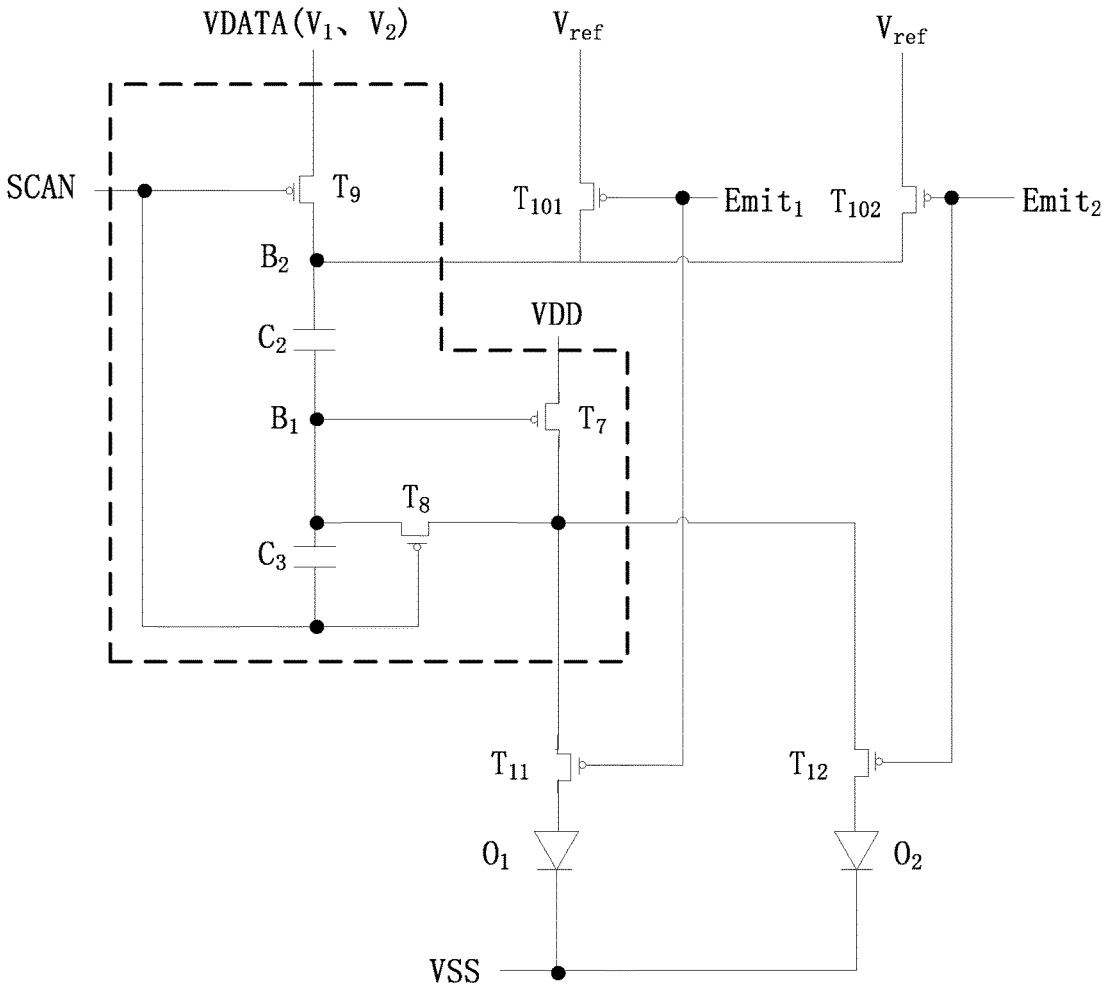
FIG. 4 is a schematic diagram showing the structure of another pixel circuit provided by an embodiments of the disclosure.

FIG. 4 is a schematic diagram showing the structure of another pixel circuit provided by an embodiment of the disclosure. The sharing unit (that is, the region of the dash line rectangle) comprises a seventh transistor $T_7$, an eighth transistor $T_8$, a ninth transistor $T_9$, a second capacitor $C_2$ and a third capacitor $C_3$. The pixel circuit further comprises N tenth transistors $T_{10}$. FIG. 4 illustratively show two tenth transistors, namely the tenth transistor $T_{101}$ and the tenth transistor $T_{102}$ respectively. An input terminal of the tenth transistor $T_{101}$ and an input terminal of the tenth transistor $T_{102}$ both are electrically connected to a reference signal line $V_{ref}$. An output terminal of the tenth transistor $T_{101}$ and an output terminal of the tenth transistor $T_{102}$ both are electrically connected to a second terminal of the second capacitor $C_2$. A control terminal of the tenth transistor $T_{101}$ is electrically connected to a control signal line $Emit_1$, and a control terminal of the tenth transistor $T_{102}$ is electrically connected to a control signal line $Emit_2$. An input terminal of the ninth transistor $T_9$ is electrically connected to a corresponding data line VDATA (including $V_1$ and $V_2$), an output terminal of the ninth transistor $T_9$ is electrically connected to the second terminal of the second capacitor $C_2$, and a control terminal of the ninth transistor $T_9$ is electrically connected to a corresponding scan line SCAN. An input terminal of the seventh transistor $T_7$ is electrically connected to a power supply signal line VDD, and a control terminal of the seventh transistor $T_7$ is electrically connected to a first terminal of the second capacitor $C_2$. An input terminal of the eighth transistor $T_8$ is electrically connected to the input terminal of the seventh transistor $T_7$. An output terminal of the eighth transistor $T_8$ is electrically connected to the first terminal of the second capacitor $C_2$ and a first terminal of the third capacitor $C_3$, and a control terminal of the eighth transistor $T_8$ is electrically connected to a scan line SCAN and a second terminal of the second capacitor $C_3$.

It is noted that, according to various embodiments, the first transistor $T_1$, the seventh transistor $T_7$, the eighth transistor $T_8$, the ninth transistor $T_9$ and the tenth transistors may be N-channel transistors, or may be with P-channel transistors. When driving light-emitting diodes through the pixel circuit, each of the input signals (such as the values of the high level voltage and low level voltage) of the pixel circuit may be changed according to the channel types of the first transistor $T_1$, the seventh transistor $T_7$, the eighth transistor $T_8$, the ninth transistor $T_9$ and the tenth transistors. Similar to the above embodiments, the first transistor $T_1$, the seventh transistor $T_7$, the eighth transistor $T_8$, the ninth transistor $T_9$ and the tenth transistors have same channel type, thus simplifying the structure of the pixel circuit and reducing the area occupied by the pixel circuit.

Figure 5:
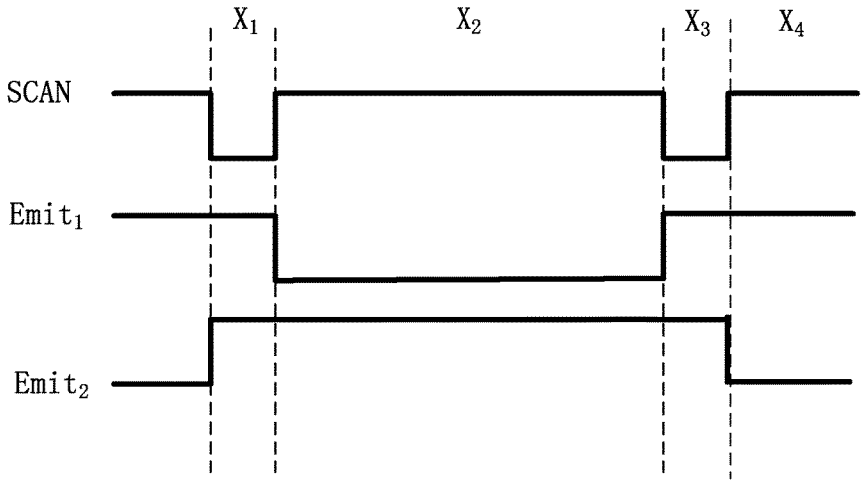
FIG. 5 is the timing diagram of a pixel circuit driving method provided by an embodiment of the disclosure.

An embodiment also provides another pixel circuit driving method used for the pixel circuit shown in FIG. 4. Illustratively, the driving method provided by the present embodiment is described using the first transistor $T_1$, the seventh transistor $T_7$, the eighth transistor $T_8$, the ninth transistor $T_9$ and the tenth transistors, of P-channel. FIG. 5 is the timing diagram of the pixel circuit driving method provided by the present embodiment. In combination of the pixel circuit shown in FIG. 4 and the timing diagram of the pixel circuit driving method shown in FIG. 5, the pixel circuit driving method includes the following steps: a first writing and compensating step $X_1$, a first light-emitting step $X_2$, a second writing and compensating step $X_3$ and a second light-emitting step $X_4$.

In the first writing and compensating step $X_1$, the scan signal of the scan line SCAN is at low level. Under the control of the scan signal of the scan line SCAN, the ninth transistor $T_9$ and the eighth transistor $T_8$ are turn on, so that the data signal $V_1$ is written into the second terminal (node $B_2$ in FIG. 4) of the second capacitor $C_2$ through the data line $V_1$. Also, due to the coupling effect of the third capacitor $C_3$, the value of the potential of the first terminal (node $B_1$ in FIG. 4) of the second capacitor $C_2$ is pulled down, so that the seventh transistor $T_7$ is turned on and the the power supply voltage VDD is inputted through power supply signal line, and the current flows through the seventh transistor $T_7$ and the eighth transistor $T_8$, and hence the potential of the node $B_1$ is being continuously pulled up until the potential of the node $B_1$ is VDD−|Vth| (where Vth is the threshold voltage of the seventh transistor $T_7$), and then the seventh transistor $T_7$ is turned off.

In the light-emitting step $X_2$, the input voltage of the control signal line $Emit_1$ is at low level. Under the control of the input voltage of the control signal line $Emit_1$, the tenth transistor $T_{101}$ and the first transistor $T_{11}$ electrically connected to the control signal line $Emit_1$ are turned on, so that the reference voltage $V_{ref}$ is written into the second terminal (node $B_2$) of the second capacitor $C_2$ by the reference signal line $V_{ref}$. Due to the coupling effect of the capacitor, the potential of node $B_1$ is changed to $$\frac{C_2}{(C_2+C_3)}(V_{ref}-V_1)+VDD-|V_{th}|.$$

Then, the seventh transistor $T_7$ is turned on, so that the light-emitting diode $O_1$ electrically connected to the first transistor $T_{11}$ emits light. According to the current calculating formula for the light-emitting diode $I=K(V_{SG}-|V_{th}|)^2$, the current of the light-emitting diode $O_1$ is $$I_1 = K\left\{\left|VDD-\left[\frac{C_2}{(C_2+C_3)}(V_{ref}-V_1)+VDD-|V_{th}|\right]\right|-|V_{th}|\right\}^2 = K\left[\frac{C_2}{(C_2+C_3)}(V_{ref}-V_1)\right]^2.$$

In the second writing and compensating step $X_3$, the scan signal of the scan line SCAN is at low level. Under the control of the scan signal of the scan line SCAN, the ninth transistor $T_9$ and the eighth transistor $T_8$ are turn on, so that the data signal $V_2$ is written into the second terminal (node $B_2$ in FIG. 4) of the second capacitor $C_2$ through the data line. Also, due to the coupling effect of the third capacitor $C_3$, the value of the potential of the first terminal (node $B_1$ in FIG. 4) of the second capacitor $C_2$ is pulled down, so that the seventh transistor $T_7$ is turned on and the power supply voltage VDD is inputted through the power supply signal line, the current flows through the seventh transistor $T_7$ and the eighth transistor $T_8$ and hence the potential of the node $B_1$ is being continuously pulled up until the potential of the node $B_1$ is VDD−|Vth|(Vth is the threshold voltage of the seventh transistor $T_7$), when the seventh transistor $T_7$ is turned off.

In the second light-emitting step $X_4$, the input voltage of the control signal line $Emit_1$ is at low level. Under the control of the input voltage of the control signal line $Emit_1$, the tenth transistor $T_{101}$ and the first transistor $T_{11}$ electrically connected to the control signal line $Emit_1$ are turned on, and the reference voltage $V_{ref}$ is written into the second terminal (node $B_2$) of the second capacitor $C_2$ by the reference signal line $V_{ref}$. The potential of node $B_1$ is changed to $$\frac{C_2}{(C_2+C_3)}(V_{ref}-V_2)+VDD-|V_{th}|$$

due to the capacitor coupling effect. At this moment, the seventh transistor $T_7$ is turned on and the light-emitting diode $O_1$ electrically connected to the first transistor $T_{11}$ emits light. According to the current calculating formula of the light-emitting diode $I=K(V_{SG}-|V_{th}|)^2$, the current of the light-emitting diode $O_1$ is $$I_1 = K\left\{\left|VDD-\left[\frac{C_2}{(C_2+C_3)}(V_{ref}-V_2)+VDD-|V_{th}|\right]\right|-|V_{th}|\right\}^2 = K\left[\frac{C_2}{(C_2+C_3)}(V_{ref}-V_2)\right]^2.$$

So far, scan displaying of a frame of image has finished, and the scan display of the next frame of image will start when next SCAN1 with a low level arrives. The display process is repeated in such a way.

In the present embodiment, the driving method for the pixel circuit enables the current of the light-emitting diode to be independent of the threshold voltage of the seventh transistor (i.e., the driving transistor), thus effectively solving the problem of the non-uniform display due to the drift of the threshold voltage of the driving transistor. In addition, unlike the configuration in the related art that a pixel circuit is provided for each of the light-emitting diodes and a complicated circuit is arranged in the region of the pixel unit including the light-emitting diode in order to solve the problem of the non-uniform display due to the drift of the threshold voltage of the driving transistor. In the present embodiment, more than one light-emitting diodes is configured to share a pixel circuit, so that the light-emitting diodes can be disposed in the region of the pixel circuit. That is, more than one pixel units may be disposed in the region of the pixel circuit, thus sufficiently decreasing the size of the pixel unit and significantly improving the resolution of the display panel.

In the case that the pixel circuit comprises N light-emitting control unit, each of the light-emitting control units comprises a first transistor, the driving method for the pixel circuit is performed as the following steps: a writing and compensate step and a light-emitting step.

In the writing and compensate step, under the control of a scan signal of the scan line, the ninth transistor and the eighth transistor are turned on, so that the data line inputs the data signal to the second terminal of the second capacitor, the third capacitor pulls down the potential of the first terminal of the second capacitor, the seventh transistor is turned on, and the power signal line inputs the power supply, and the potential of the first terminal of the second capacitor increases until the seventh transistor is turn off.

In the light-emitting step, under the control of an input voltage of the control signal line, the tenth transistor and the first transistor electrically connected to the control signal line are turned on, so that the reference signal line inputs the reference voltage to the second terminal of the second capacitor, and the seventh transistor is turned on, the light-emitting diode electrically connected to the first transistor emits light.

By this method, the writing and compensating step and the light-emitting step described above in sequence until the N light-emitting diodes emit light one by one.

It is noted that, the embodiment above described is explained in case of that the first transistors, the seventh transistor, the eighth transistor, the ninth transistor and the tenth transistors all have P type channel. In the case that the first transistors, the seventh transistor, the eighth transistor, the ninth transistor and the tenth transistors all have N type channel, the scan signal of each of the scan lines, the input voltage of the strobe signal line and the input voltage of each control signal line are changed from a low level to a high level.

Figure 6:
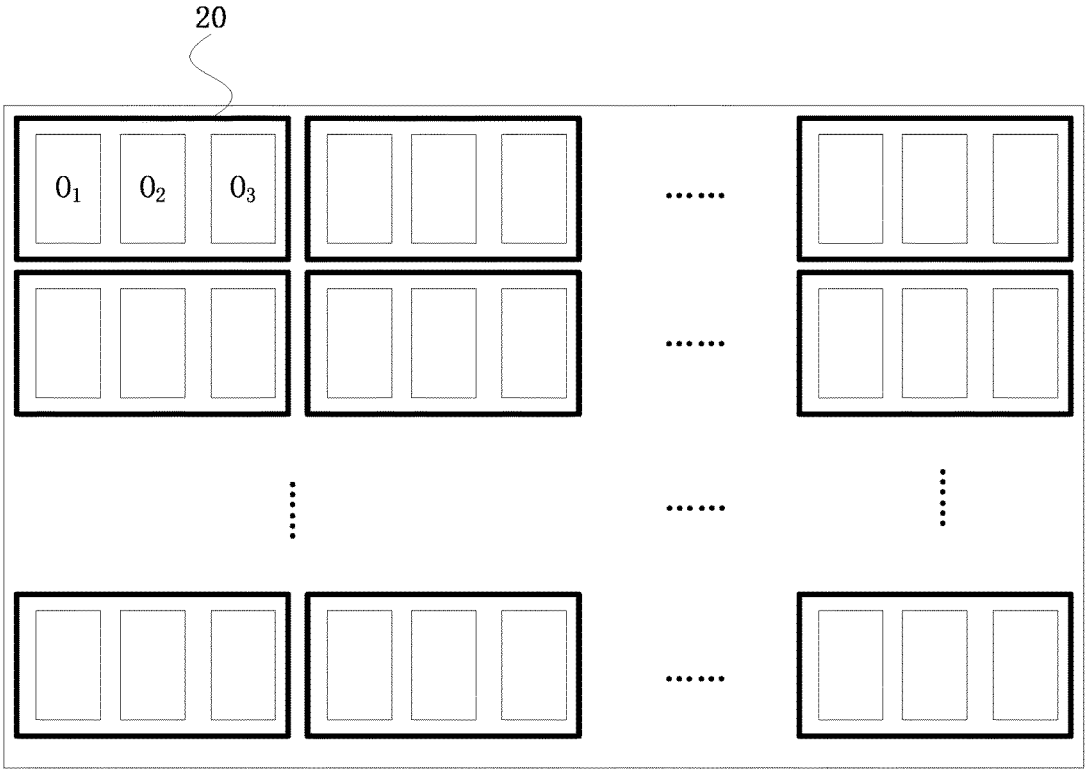
FIG. 6 is a schematic diagram showing the structure of a display panel provided by an embodiment of the disclosure.

The embodiment also provides a display panel. FIG. 6 is a schematic diagram showing the structure of a display panel provided by an embodiment of the disclosure. As shown in FIG. 6, the display panel includes a plurality of the pixel circuits 20 according to in the above embodiments and a plurality of light-emitting elements $O_N$. The plurality of light-emitting elements $O_N$ are arranged in an array, and N light-emitting elements in a row of the array share a sharing unit of one of the pixel circuits 20 (not shown). Each of the plurality of the pixel circuits 20 is configured to drive N light-emitting elements $O_N$ to emit light one by one. As the exemplary arrangement in FIG. 6, each of the pixel circuits 20 is configured to drive three light-emitting diodes in a row of the array to emit light one by one and the three light-emitting diodes are indicated by $O_1$, $O_2$ and $O_3$ respectively.

In the display panel provided by the embodiments of the present disclosure, N light-emitting elements share one pixel circuit, and each of the light-emitting elements defines a a region of one pixel unit, so that more than one light-emitting elements can be disposed in the region of the pixel circuit while being compatible with the function of the pixel circuit in the related art. Compared with the configuration in the related art that each light-emitting element requires a pixel circuit (that is, a complicated circuit is disposed in the pixel unit defined by a light-emitting element), the pixel circuit of the disclosure may significantly reduce the size of the pixel unit, and hence the resolution of the display panel is significant improved. For example, the resolution of the display panel shown in FIG. 6 is three times than the resolution of the display panel in the related art that one pixel circuit is disposed for one pixel unit.

It is noted that, throughout FIGS. 1 to 6, the same elements are indicated by identical drawing reference numbers. The same elements are not discussed repeatedly in detail, and those skilled in the art may understand the content of the drawings according to the related specific description.

The preferred embodiments of the present invention are described as above, but are not intended to limit the present invention. Any modifications, equivalent substitutions, improvements, etc., that are made without departing from the spirit and principle of the present invention should fall into the scope of protection of the present invention.

The invention claimed is:

1. A pixel circuit, comprising:

a sharing unit, N light-emitting control units and N first transistors, wherein N is positive integer greater than or equal to 2; and, wherein the N light-emitting control units are configured such that: an output terminal of each of the N light-emitting control units is electrically connected to a light-emitting element; and a control terminal of each of the N light-emitting control units is configured to be electrically connected to a respective one of N control signal lines; and the sharing unit is configured to drive, through each of the light-emitting control units, the light-emitting element electrically connected to the light-emitting control unit;

wherein the sharing unit comprises a second transistor, a third transistor, a fourth transistor, a first capacitor and a second capacitor;

an input terminal of the second transistor is configured to be electrically connected to a power signal line, a control terminal of the second transistor is electrically connected to a first terminal of the first capacitor, and an output terminal of the second transistor is electrically connected to an input terminal of each of the N light-emitting control units;

an input terminal of each of the N first transistors is configured to be electrically connected to a reference signal line, an output terminal of each of the N first transistors is electrically connected to a second terminal of the first capacitor, a control terminal of each of the N first transistors is configured to be electrically connected to a respective one of the N control signal lines;

an input terminal of the fourth transistor is configured to be electrically connected to a data line, an output terminal of the fourth transistor is directly electrically connected to the second terminal of the first capacitor, a control terminal of the fourth transistor is configured to be electrically connected to a scan line; and an input terminal of the third transistor is electrically connected to an output terminal of the second transistor, an output terminal of the third transistor is electrically connected to the first terminal of the first capacitor and a first terminal of the second capacitor, and a control terminal of the third transistor is configured to be electrically connected to the scan line and a second terminal of the second capacitor.

2. The pixel circuit of claim 1, wherein, each of the N light-emitting control units comprises a fifth transistor, and the light-emitting element is a light-emitting diode; wherein an output terminal of the fifth transistor is configured to be electrically connected to an anode of the light-emitting diode, and a control terminal of the fifth transistors is configured to be electrically connected to a corresponding control signal line; a cathode of the light-emitting diode is electrically connected to the ground.

3. The pixel circuit of claim 2, wherein, the first transistor, the second transistor, the third transistor, the fourth transistor and the fifth transistors have an identical channel type.

4. A method, for driving the pixel circuit according to claim 2, comprising repeatedly performing a writing and compensate step and a light-emitting step in sequence until the N light-emitting diodes emit light one by one; and, wherein in the writing and compensate step, under the control of a scan signal of the scan line, the fourth transistor and the third transistor are turned on, so that the data line inputs the data signal to the second terminal of the first capacitor, the second capacitor pulls down the potential of the first terminal of the first capacitor, the second transistor is turned on, and the power signal line inputs the power supply, and the potential of the first terminal of the first capacitor increases until the second transistor is turn off; and in the light-emitting step, under the control of an input voltage of the control signal line, the first transistor and the fifth transistor electrically connected to the control signal line are turned on, so that the reference signal line inputs the reference voltage to the second terminal of the first capacitor, and the second transistor is turned on, the light-emitting diode electrically connected to the fifth transistor emits light.

5. A display panel, comprising:

a plurality of the pixel circuits and a plurality of light-emitting elements; and, wherein the plurality of light-emitting elements are arranged in an array, and N light-emitting elements in a row of the array share one of the plurality of the pixel circuits, wherein, each of the plurality of the pixel circuits comprises a sharing unit, N light-emitting control units and N first transistors, wherein N is positive integer greater than or equal to 2, and wherein an output terminal of each of the N light-emitting control units is electrically connected to a light-emitting element; and a control terminal of each of the N light-emitting control units is configured to be electrically connected to a respective one of N control signal lines; and the sharing unit is configured to drive, through each of the N light-emitting control units, the light-emitting element electrically connected to the light-emitting control unit;

wherein the sharing unit comprises a second transistor, a third transistor, a fourth transistor, a first capacitor and a second capacitor;

an input terminal of the second transistor is configured to be electrically connected to a power signal line, a control terminal of the second transistor is electrically connected to a first terminal of the first capacitor, and an output terminal of the second transistor is electrically connected to an input terminal of each of the N light-emitting control units;

an input terminal of each of the N first transistors is configured to be electrically connected to a reference signal line, an output terminal of each of the N first transistors is electrically connected to a second terminal of the first capacitor, a control terminal of each of the N first transistors is configured to be electrically connected to a respective one of the N control signal lines;

an input terminal of the fourth transistor is configured to be electrically connected to a data line, an output terminal of the fourth transistor is directly electrically connected to the second terminal of the first capacitor, a control terminal of the fourth transistor is configured to be electrically connected to a scan line; and an input terminal of the third transistor is electrically connected to an output terminal of the second transistor, an output terminal of the third transistor is electrically connected to the first terminal of the first capacitor and a first terminal of the second capacitor, and a control terminal of the third transistor is configured to be electrically connected to the scan line and a second terminal of the second capacitor.

6. The display panel of claim 5, wherein each of the N light-emitting control units comprises a fifth transistor, and the light-emitting element is a light-emitting diode; and, wherein an output terminal of the fifth transistor is electrically connected to an anode of the light-emitting diode, and a control terminal of the fifth transistors is configured to be electrically connected to a corresponding control signal line; a cathode of the light-emitting diode is electrically connected to the ground.

7. The display panel of claim 6, wherein the first transistor, the second transistor, the third transistor, the fourth transistor and the fifth transistors have an identical channel type.

* * * * *